US009147962B2

(12) United States Patent
Yoshida et al.

(10) Patent No.: US 9,147,962 B2
(45) Date of Patent: Sep. 29, 2015

(54) CONNECTOR

(75) Inventors: Haruki Yoshida, Kakegawa (JP); Osamu Shinmura, Toyota (JP); Jun Asada, Toyota (JP); Kazuhiro Yokoyama, Toyota (JP); Tsuyoshi Mizushima, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 120 days.

(21) Appl. No.: 14/111,114

(22) PCT Filed: May 25, 2012

(86) PCT No.: PCT/JP2012/063544

§ 371 (c)(1),
(2), (4) Date: Oct. 10, 2013

(87) PCT Pub. No.: WO2012/161328

PCT Pub. Date: Nov. 29, 2012

(65) Prior Publication Data

US 2014/0030926 A1 Jan. 30, 2014

(30) Foreign Application Priority Data

May 25, 2011 (JP) ..... 2011-116680

(51) Int. Cl.

| | |
|---|---|
| ***H01R 25/00*** | (2006.01) |
| ***H01R 13/53*** | (2006.01) |
| ***H01R 13/56*** | (2006.01) |
| ***H01R 35/04*** | (2006.01) |

(52) U.S. Cl.

CPC ..... *H01R 13/53* (2013.01); *H01R 13/565* (2013.01); *H01R 35/04* (2013.01)

(58) Field of Classification Search

CPC ..... H01R 35/04; H01R 13/514; H01R 31/02
USPC ..... 439/701, 713, 686, 534, 954, 640, 652
See application file for complete search history.

(56) References Cited

U.S. PATENT DOCUMENTS

| | | | | |
|---|---|---|---|---|
| 2,652,546 | A * | 9/1953 | Christner | 439/8 |
| 6,750,410 | B2 * | 6/2004 | Lee | 200/51.03 |
| 7,887,332 | B2 * | 2/2011 | Bauer et al. | 439/13 |
| 2007/0218736 | A1 | 9/2007 | Takizawa et al. | |
| 2008/0054701 | A1 | 3/2008 | Yoshida et al. | |

FOREIGN PATENT DOCUMENTS

| | | | |
|---|---|---|---|
| JP | 2006-128025 | A | 5/2006 |
| JP | 2006128025 | A * | 5/2006 |

(Continued)

OTHER PUBLICATIONS

Written Opinion (PCT/ISA/237), dated Aug. 14, 2012, issued by the International Searching Authority in counterpart International Patent Application No. PCT/JP2012/063544.
International Search Report (PCT/ISA/210), dated Aug. 14, 2012, issued by the International Searching Authority in counterpart International Patent Application No. PCT/JP2012/063544.

(Continued)

*Primary Examiner* — Phuong Dinh
(74) *Attorney, Agent, or Firm* — Sughrue Mion, PLLC

(57) ABSTRACT

Provided with a first connector part to connect a first cable, a second connector part to connect a second cable, and to fit with a first connector part, thereby ensuring electrical connection between a first cable and a second cable, and a housing to hold a second connector part rotatably around an axial direction of a second cable.

3 Claims, 2 Drawing Sheets

(56) References Cited

FOREIGN PATENT DOCUMENTS

| | | | |
|---|---|---|---|
| JP | 2007-227256 | A | 9/2007 |
| JP | 2007-250362 | A | 9/2007 |
| JP | 2008-52976 | A | 3/2008 |
| JP | 2008-52982 | A | 3/2008 |
| JP | 2008-257983 | A | 10/2008 |

OTHER PUBLICATIONS

Search Report dated Sep. 26, 2014 issued by the European Patent Office in counterpart European Patent Application No. 12789374.1.
Office Action dated May 6, 2015 issued by the State Intellectual Property Office of the People's Republic of China in counterpart Chinese Patent Application No. 201280024740.8.

* cited by examiner

CONNECTOR

TECHNICAL FIELD

The present invention relates to a connector.

BACKGROUND ART

A conventional connector is disclosed in JP-A-2007-227256 (Patent Document 1), JP-A-2008-257983 (Patent Document 2), and JP-A-2007-250362 (Patent Document 3).

RELATED ART DOCUMENT

Patent Document

Patent Document 1: JP-A-2007-227256
Patent Document 2: JP-A-2008-257983
Patent Document 3: JP-A-2007-250362

DESCRIPTION OF THE INVENTION

Problems to be Solved by Invention

A connector is used for electrically connecting cables. In a cable, a force of rotating a cable around an axial direction (hereinafter, referred to as a rotation force) is generated when wiring, connecting, or using a cable.

In particular, as for a cable with a diameter larger than that of a normal cable (wire harness), namely a cable to be used for a high-voltage electrical system configured to flow high voltage and high current, a large rotation force is generated. As a result, a large force is applied to an area of a connector to connect cables.

It is an object of the invention to solve the above problem, and to provide a connector having a structure capable of absorbing a force generated in a cable to rotate a cable around an axial direction.

Means for Solving the Problems

The above object of the invention is achieved by a connector configured as follows.

(1) A connector comprising a first connector part to connect a first cable, a second connector part to connect a second cable and to fit with the first connector part, thereby ensuring electrical connection between the first cable and second cable, and a housing to hold the second connector part rotatably around an axial direction of the second cable, wherein in a state that the first connector part fits with the second connector part, the first connector part and second connector part are rotatable with respect to the housing.

(2) The connector having the above configuration (1), wherein the first connector part comprises a male electrode to connect the first cable, and a cylindrical part provided around the male electrode; the second connector part comprises a female electrode to connect the second cable, and a columnar part provided with the female electrode inside, and housed in the cylindrical part; and the housing includes a housing part to house the columnar part rotatably around the axial direction.

(3) The connector having the above configuration (2), wherein the columnar part is provided with an annular flange extending outward in a radial direction, and the housing has a through-hole to pass through the columnar part in a state that a part of the columnar part is inserted into the housing part, and is provided with a fixing plate to pace the annular flange on the surface of the housing.

(4) The connector having the above configuration (3), wherein the one housing holds a plurality of the second connector parts, a plurality of the first connector parts is provided to fit with each of the plurality of the second connector parts, and one the fixing plate is provided with a plurality of the through-holes corresponding to the number of the plurality of first connector parts.

BRIEF DESCRIPTION OF THE DRAWINGS

FIG. 3(A) shows a state before rotation. FIG. 3(B) shows a state after rotation.

MODE FOR CARRYING OUT THE INVENTION

Figure 1:
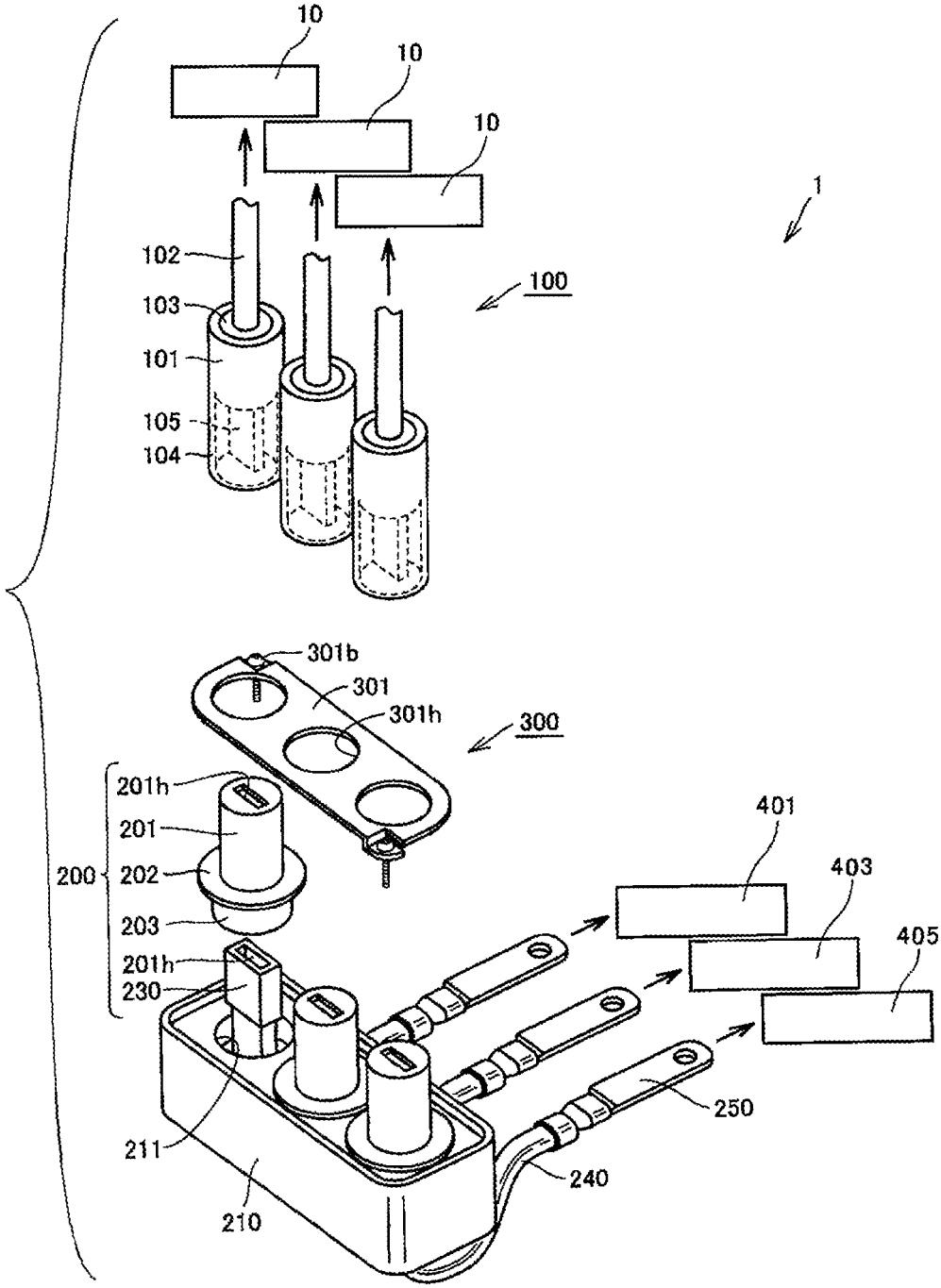
FIG. 1 is an exploded perspective view showing a structure of a connector in an embodiment of the invention.

A connector in an embodiment based on the invention will be explained hereinafter with reference to the accompanying drawings. In an embodiment explained hereinafter, unless otherwise specified, quantity and amount are not restrictive, and the scope of the invention is not limited to the quantity and amount. The same or equivalent components are given the same reference numerals, and explanation thereof is omitted.

A connector in an embodiment is shown as an example used for connection between a stator of a rotary electric machine and an inverter for rotation control. A stator has a three-phase winding (U-phase, V-phase, W-phase) structure.

Figure 2:
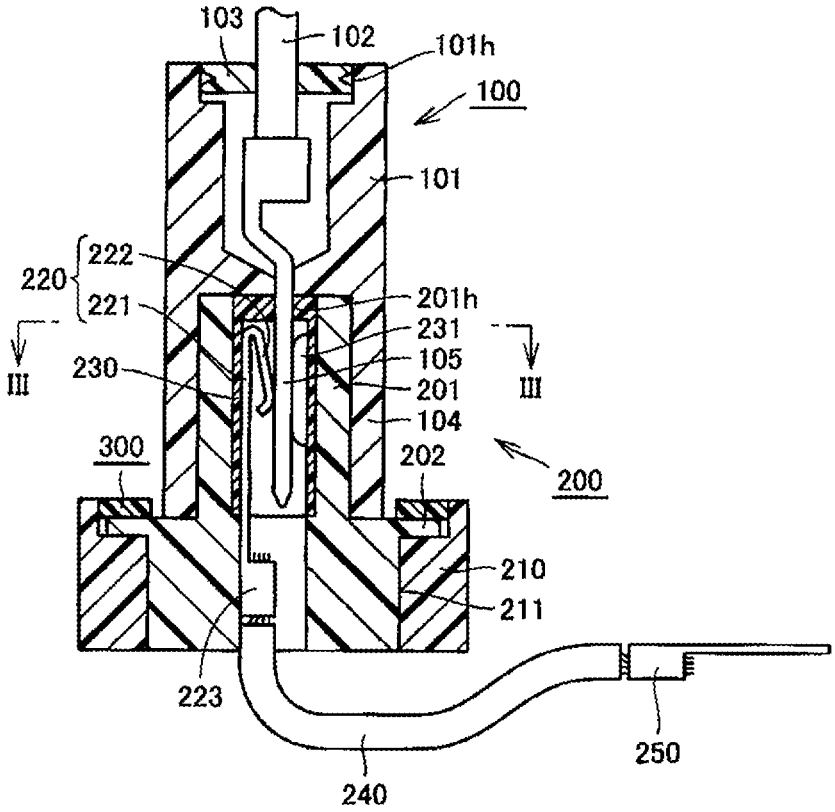
FIG. 2 is a vertical cross-sectional view showing a structure of a connector in an embodiment of the invention.

First, referring to FIG. 1 and FIG. 2, a structure of a connector 1 in an embodiment will be explained. FIG. 1 is an exploded perspective view showing a structure of a connector 1. FIG. 2 is a vertical cross-sectional view showing a structure of a connector 1.

(Connector 1)

A connector 1 in an embodiment 1 includes a first connector part 100 which is connected to a first cable 102 having a connection with an inverter 10; a second connector part 200 which is connected to a second cable 240 having a connection with a stator U-phase 401, a stator V-phase 403, or a stator W-phase 405, respectively of a not-shown stator, said second connector part 200 being fit with the first connector part 100 to ensure electrical connection between the first cable 102 and the second cable 240; and a housing 210 to hold the second connector part 200 rotatably around the axial direction of the second cable 240.

The embodiment includes three first connector parts 100, three second connector parts 200 respectively provided fro the three first connector parts 100, and one housing 210 to hold said three second connector parts 200.

(First Connector Part 100)

As shown in FIG. 1 and FIG. 2, the first connector part 100 comprises a male electrode 105 to be connected to the first cable 102, and a cylindrical part 104 provided with surrounding the male electrode 105. The first connector part 100 has a main body unit 101. The cylindrical part 104 is provided extending along an axial direction from an outer circumference of the main body unit 101. The main body unit 101 is provided with an opening 101*h* to make the first cable 102 pass through it. A seal member 103 is fit between the first cable 102 and the opening 101*h*. The main body unit 101 and cylindrical part 104 are integrally molded with resin material or the like.

(Second Connector Part 200)

As shown in FIG. 1 and FIG. 2, the second connector part 200 comprises a female electrode 220 to be connected to one end of the second cable 240, and a columnar part 201 provided with the female electrode 220 inside, and housed in the cylindrical part 104 of the first connector part 100. A terminal 250 is connected to the other end of the second cable 240.

In the embodiment, as will be described later, as the first connector part 100 and second connector part 200 rotate with respect to the housing 210, some twist occurs in the second cable 240. Thus, use of a braided cable is preferable. It is also preferable to make wiring so as to bend downward the housing 210 with some room (extra length).

Inside the columnar part 201, at a position opposite to the female electrode 220, an elastic member 231 is provided to hold the male electrode 105 together with the female electrode 220. The female electrode 220 has a base portion 221 and a bent portion 222 to hold an elastic force. On the side of the base portion 221 opposite to the bent portion 222, a crimping portion 223 is provided to connect the second cable 240.

In the front end portion of the columnar part 201 close to the first connector part 100, a communication hole 201*h* is provided to insert the male electrode 105. The opening shape of the communication hole 201*h* is rectangular corresponding to a cross-sectional shape of the male electrode 105. However, the shape of the male electrode 105 and the opening shape of the communication hole 201*h* are not to be limited to the shapes in the embodiment.

In the embodiment, the columnar part 201 contains a resin block 230 that houses the female electrode 220 and elastic member 231, and has the communication hole 201*h* in the front end portion.

On the outer circumference of the columnar part 201, the annular flange 202 is provided extending outward in the radial direction. In the embodiment, across the annular flange 202, the outer diameter of the columnar part 201 is greater in a part 203 close to the housing 210 than in a part close to the first connector part 100.

An outer diameter shape of the columnar part 201 is not to be limited to the shape in the embodiment. The annular flange 202 may not be continuous in the circumferential direction, and may be provided discontinuously. The columnar part 201 and annular flange 202 are integrally molded with resin material or the like.

(Housing 210)

As shown in FIG. 1 and FIG. 2, the housing 210 is provided with a housing part 211 at three locations for housing the columnar part 201 of the second connector part 200 rotatably around the axial direction. The inner diameter of the housing part 211 is substantially the same as or a little larger than the outer diameter of the part 203 of the annular flange 202 close to the housing 210 in the columnar part 201.

In a state that the columnar part 201 of the second connector part 200 is inserted into the housing part 211, a part of the columnar part 201, namely the part 203, is housed in the housing part 211, and positioned by the annular flange 202. Further, for fixing the second connector part 200 to the housing 210 rotatably around the axial direction, a fixing plate 300 is provided to place the annular flange 202 of the second connector part 200 on the surface of the housing 210.

The fixing plate 300 is provided with a through-hole 301*h* at three locations for passing through the columnar part 201 of the second connector part 200. The fixing plate 300 is fixed to the housing 210 with a fixing screw 301*b*.

Next, a function of the connector 1 having the above configuration will be explained by referring to FIGS. 3(A) and 3(B). In a state that the first connector part 100 is fit with the second connector part 2, the first connector part 100 and second connector part 200 are rotatable with respect to the housing 210.

Figure 3A:
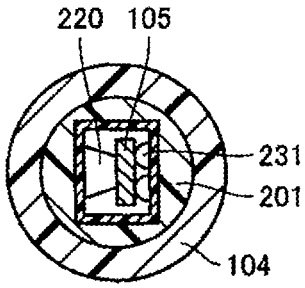
FIGS. 3(A) and 3(B) are cross-sectional views taken along arrows III-III in FIG. 2.
Figure 3B:
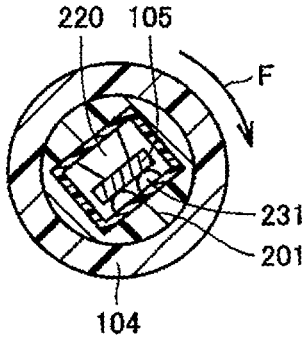

As a result, when a force to rotate the first cable 102 around the axial direction of the first cable 102 occurs, the first connector part 100 and second connector part 200 rotate with respect to the housing 210 (the states of FIG. 3(A) to 3(B), F in the drawing indicates the rotational direction around the axial direction).

As a result, a rotation force around the axial direction of the first cable 102 applied between the first connector part 100 and second connector part 200 is absorbed by the rotation of the first connector part 100 and second connector part 200. This reduces a rotation force around the axial direction of the first cable 102 acting between the first connector part 100 and second connector part, and maintains a stable contact state between the male electrode 105 and female electrode 220 (the state of FIG. 3(B)).

For example, according to a conventional connector, when a rotation force around the axial direction of the first cable 102 is applied between the first connector part 100 and second connector part 200, the male electrode 105 twists against the female electrode 220, causing a part of the male electrode 105 to be separated from the female electrode 220, which is so-called partial contact. Further, the partial contact may cause damages in the male electrode 105 and female electrode 220.

However, according to the connector 1 of the embodiment, as explained above, a rotation force can be reduced around the axial direction of the first cable 102 acting between the first connector part 100 and second connector part so that a contact state in the connector 1 can be ensured.

Further, in the embodiment, the connector 1 is shown as an example used for connection between a stator of a rotary electric machine and an inverter 10 for rotation control. One housing 210 houses three first connector parts 100 and second connector parts 200. The invention is not to be limited to this configuration. The configuration of the invention may be applied to other connectors requiring similar configuration. The quantity of first connector part 100 and second connector part 200 may be appropriately selected.

Although embodiments of the invention haven been explained hereinbefore, it is to be noted that these embodiments are illustrative and not restrictive in all aspects. The scope of the invention is defined by the appended claims. All modifications are to be included in the scope and essential characteristics of the invention and its equivalency defined by the appended claims.

This application is based upon Japanese Patent Application (No. 2011-116680) filed May 25, 2011, the entire contents of which are incorporated herein by reference.

INDUSTRIAL APPLICABILITY

According to a connector based on the invention, it is possible to provide a connector having a structure capable of absorbing a force generated in a cable to rotate a cable around an axial direction.

DESCRIPTION OF REFERENCE NUMERALS AND SIGNS

1 Connector, 100 First connector part, 101 Main body unit, 101*h* Opening, 102 First cable, 103 Seal member, 104 Cylindrical part, 105 Male electrode, 200 Second connector part, 201 Columnar part, 201*h* Communication hole, 202 Annular flange, 210 Housing, 211 Housing part, 220 Female electrode, 221 Base portion, 222 Bent portion, 223 Crimping portion, 230 Resin block, 231 Elastic member, 240 Second cable, 250 Terminal, 300 Fixing plate, 301*b* Fixing screw, 301*h* Through-hole

The invention claimed is:

1. A connector, comprising:

a first connector part to connect a first cable;

a second connector part to connect a second cable and to fit with the first connector part, thereby ensuring electrical connection between the first cable and second cable; and a housing to hold the second connector part rotatably around an axial direction of the second cable;

wherein in a state that the first connector part fits with the second connector part, the first connector part and second connector part are rotatable with respect to the housing, wherein:

the first connector part comprises a male electrode to connect the first cable, and a cylindrical part provided around the male electrode;

the second connector part comprises a female electrode to connect the second cable, and a columnar part provided with the female electrode inside, and housed in the cylindrical part; and the housing includes a housing part to house the columnar part without restricting rotation of the columnar part around the axial direction.

2. The connector according to claim 1, wherein the columnar part is provided with an annular flange extending outward in a radial direction, and the housing has a through-hole to pass through the columnar part in a state that a part of the columnar part is inserted into the housing part, and is provided with a fixing plate to place the annular flange on the surface of the housing.

3. The connector according to claim 2, wherein the one housing holds a plurality of the second connector parts, a plurality of the first connector parts is provided to fit with each of the plurality of the second connector parts, and one the fixing plate is provided with a plurality of the through-holes corresponding to the number of the plurality of first connector parts.

* * * * *